US006501365B1

(12) United States Patent
Elliott et al.

(10) Patent No.: US 6,501,365 B1
(45) Date of Patent: Dec. 31, 2002

(54) IGNITION COIL HAVING A CIRCULAR CORE AND A METHOD OF MAKING THE SAME

(75) Inventors: E. Wesley Elliott, Lower Burrell, PA (US); D. Bradley Williams, Butler, PA (US); Joseph A. DeAngelo, Cheswick, PA (US)

(73) Assignee: Oberg Industries, Freeport, PA (US)

( * ) Notice: Subject to any disclaimer, the term of this patent is extended or adjusted under 35 U.S.C. 154(b) by 0 days.

(21) Appl. No.: 09/657,375

(22) Filed: Sep. 8, 2000

(51) Int. Cl.[7] ..... H01F 27/24

(52) U.S. Cl. ..... 336/234; 336/96; 336/90; 29/602.1

(58) Field of Search ..... 336/90, 96, 234; 29/606, 609, 602.1; 123/634, 635

(56) References Cited

U.S. PATENT DOCUMENTS 3,906,421 A * 9/1975 Wimmer ..... 336/178
4,663,604 A 5/1987 VanSchaick et al.
5,632,259 A * 5/1997 Konda et al. ..... 123/634
5,706,792 A * 1/1998 Boyer et al. ..... 123/634
5,929,736 A * 7/1999 Sakamaki et al. ..... 336/96
5,986,532 A 11/1999 Kikuta et al.
6,025,770 A 2/2000 Okamoto et al.
6,208,231 B1 * 3/2001 Oosuka et al. ..... 336/107
6,353,378 B1 * 3/2002 Oosuka et al. ..... 336/96

* cited by examiner

*Primary Examiner*—Ahn T. Mai
(74) *Attorney, Agent, or Firm*—Arnold B. Silverman; William F. Lang, IV; Eckert Seamans Cherin & Mellott, LLC

(57) ABSTRACT

An ignition coil contains an elongated substantially circular coil core which includes a primary coil and a secondary coil each disposed radially outwardly of the core with the core composed of a plurality of generally rectangular elements at least some of which have a different width than others and the elements being in surface-to-surface contact with each other. The lateral walls of the elements may have a shape which is not perpendicular to the longitudinal extent of the elements. The core may be welded at its ends. A core contained within this ignition coil, which may be an automotive ignition coil, is disclosed. A method of making such an ignition coil may include providing a plurality of generally rectangular elongated generally flat metal elements, at least some of which have different widths than others, assembling the elements with the element of greatest widths toward the center and those of progressively reduced widths being on opposed sides thereof, and mechanically machining the lateral edges of at least a majority of the elements to create a coil assembly having a circular or substantially circular core shape. The core assembly may be deburred, and smears removed to create a smooth exterior shape and joined as by welding. The core has a greater weight for a given diameter than one of comparable diameter which has a stepped configuration.

37 Claims, 3 Drawing Sheets

IGNITION COIL HAVING A CIRCULAR CORE AND A METHOD OF MAKING THE SAME

BACKGROUND OF THE INVENTION

1. Field of the Invention

The present invention relates to ignition coils and cores for the same along with a method of making the same and, more specifically, it relates to an improved construction of such cores.

2. Description of the Prior Art

In connection with ignition coils, such as those used in internal combustion engines, it has been known to provide a transformer having a magnetic core with a surrounding primary coil which is adapted to be energized in order to generate a magnetic field, along with a secondary coil which, as a result of such magnetic field, receives an induced electromotive force.

As the result of the difficulty in machining silicon steel, it has been suggested previously to assemble a plurality of laminated plates to create a stepped profile for the core. See U.S. Pat. Nos. 5,986,532 and 6,025,770.

It has also been suggested to provide an epoxy material over the outer stepped configuration. See U.S. Pat. No. 4,663,604.

It has been known in recent years to provide auto ignitions which rather than having a single ignition coil providing energy to each spark plug has a single smaller coil for each spark plug in the internal combustion engine. As the length of such a laminated stack core may be on the order of ten times the widest lamination, these cores are frequently designated as "pencil cores."

With the prior art laminated externally stepped construction, the cross-section was generally round, but as a result of the steps and the flattened top and bottom laminations, the construction did not approximate a circular profile. This served to reduce the weight of the stepped core per unit length, as a result of the reduced total amount of metal as compared with a circular shape. Further, in view of the sharp edges on the individual lamina, an insulator had to be added thereover in order to resist cutting the wire wrapped around the laminations.

There remains, therefore, a need for an improved construction for ignition cores.

SUMMARY OF THE INVENTION

The present invention has met the above-described need by providing an ignition coil and core as well as the method of making the same, which eliminates the prior art problems hereinbefore described.

As employed herein, the term "automotive ignition" means ignitions for internal combustion engines for vehicles, including, but not limited to, automobiles, sports utility vehicles, trucks, boats, airplanes, locomotives, and other land vehicles powered by internal combustion engines, as well as other equipment employing spark plugs.

As employed herein, the term "substantially circular" means either (a) circular, or (b) a configuration which apart from a single pair of opposed flat plate portions at the upper and lower extremities (if present) is substantially circular and expressly excludes previously known conventional stepped circumferential configurations.

The present invention provides an ignition coil, which may be an automotive ignition coil, which has an elongated substantially circular coil core and a radially outwardly disposed primary coil and a radially outwardly disposed secondary coil. The core is composed of a plurality of generally rectangular elements, at least some of which have different widths than others with the adjacent elements being in surface-to-surface contact with each other.

The sidewalls of the individual elements may be curved or have other configurations which are not generally perpendicular to the longitudinal extent of the elements. The assembly of elements is joined to each other preferably by welding at the ends.

In the preferred method of manufacturing the ignition coil core, a plurality of generally rectangular elongated generally flat elements, at least some of which have different widths, are assembled with the elements of greatest width positioned in the center and elements of progressively reduced width being provided on opposed sides thereof. While the starting point could be elements of the same width, this would be wasteful of material. The individual elements are then subjected to machining of the lateral edges to establish the configuration of a substantially circular core cross-sectional shape. The machining preferably involves mechanical machining followed by electrochemical machining. Subsequently, the assembly of reformed core elements is joined as by welding or other suitable means which will be known to those skilled in the art. In a preferred practice, deburring is provided.

It is an object of the present invention to provide an improved ignition coil having a uniquely configurated core configuration and a method of manufacturing the same.

It is a further object of the present invention to provide such an ignition coil which is adapted to be employed with conventional coil construction and energizing means.

It is a further object of the present invention to provide such a core that has a smooth outer surface which eliminates the need to coat the exterior surface thereof.

It is a further object of the present invention to provide such cores which are of uniform quality and performance characteristics from core to core.

It is a further object of the present invention to provide such cores which as a result of the substantially circular configuration has increased weight for a given diameter as compared with a corresponding stepped core of the same diameter or maximum transverse direction.

It's another object of the present invention to provide a core having improved electrical performance characteristics.

It is a farther object of the present invention to provide a method for making a substantially circular ignition coil and the resulting core.

It is a further object of the present invention to provide such an ignition core, which eliminates the need for providing an insulator therearound to resist cutting the wire laminations wrapped around the core.

It is a further object of the present invention to provide such an ignition core which can be manufactured economically and rapidly.

These and other objects of the present invention will be more fully understood from the following detailed description of the invention on reference to the illustrations appended hereto.

DESCRIPTION OF THE PREFERRED EMBODIMENTS

Figure 1:
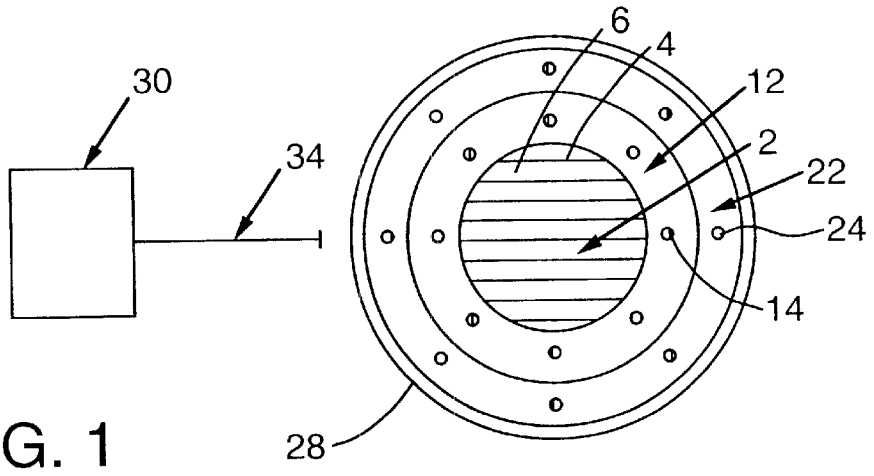
FIG. 1 is a partially schematic cross-sectional illustration of an ignition coil of the present invention.

Referring once again to FIG. 1, there is shown, partially schematically, a core 2 composed of a plurality of individual lamina elements, such as 4, 6, for example. The core is made of a metal, such as silicon steel. Disposed radially exteriorly of the core 2 is a primary winding 12, which has an electrically conductive wire, such as 14, wound therearound. Disposed radially exteriorly of the core 2 is a primary winding 14 is secondary winding 22 which has a wire 24 wound therearound. An exterior sleeve 28 protectively surrounds the ignition coil interior components.

In conventional operation, a source of electrical energy 30 electrically energizes the primary coil 12 through lead 34 which is connected to the ignition coil through primary winding 14 which, in turn, emits a magnetic field therearound to induce an electromotive force in secondary coil 24. This induced current serves to provide the pulsed energy to the spark plug.

Figure 2:
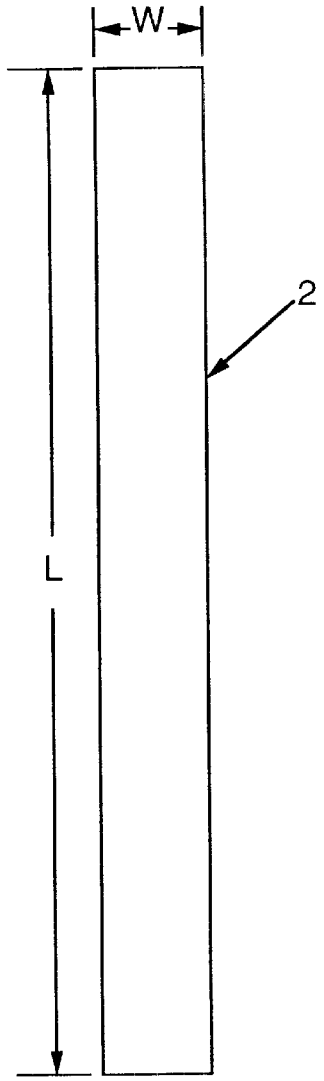
FIG. 2 is an elevational view of an ignition core of the present invention.

In the form of core 2, as shown in FIG. 2, the length L will generally be about 4.5 to 8 times of the maximum width W of the core.

Figure 3:
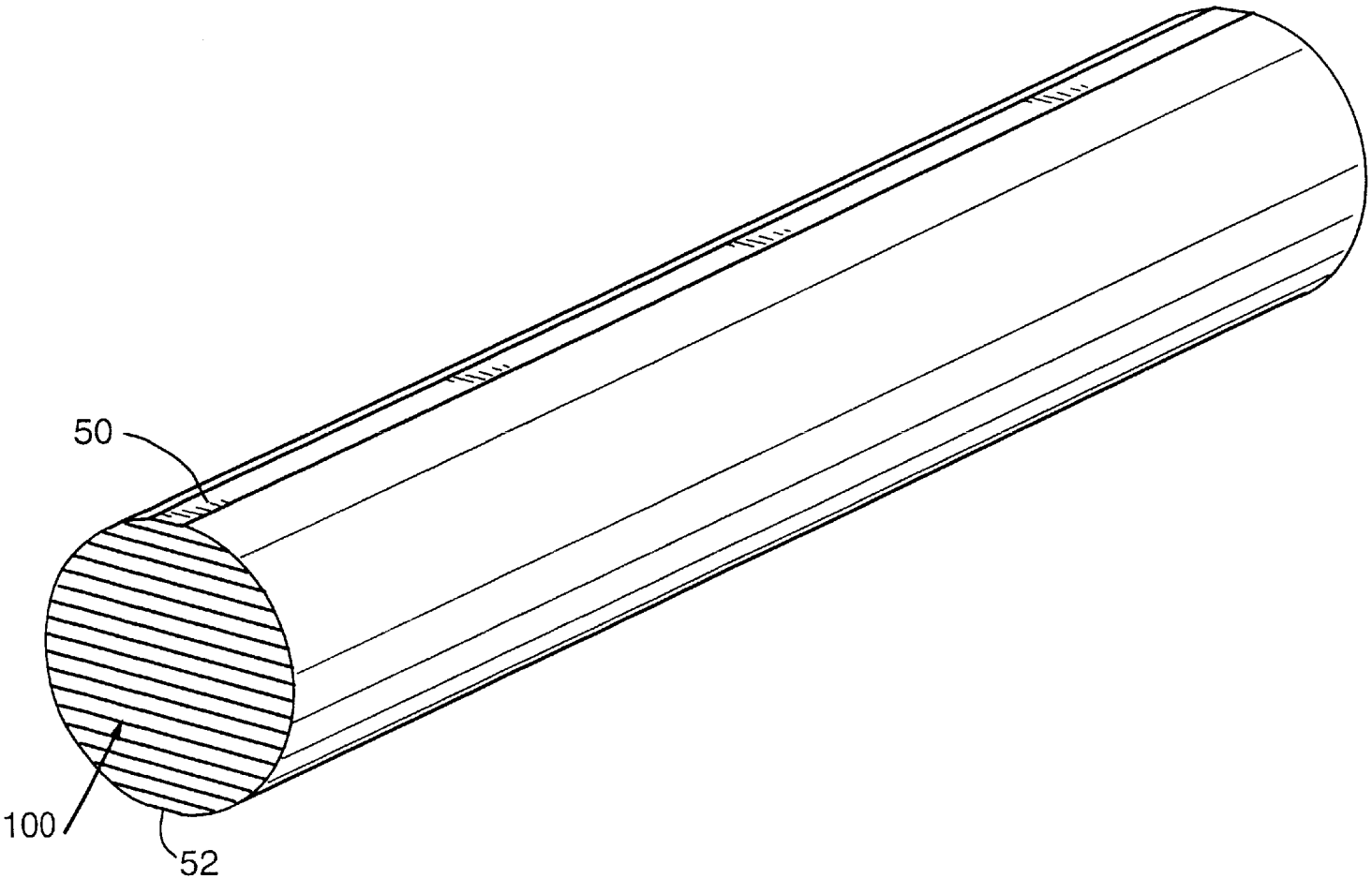
FIG. 3 is a perspective view of an ignition core of the present invention.
Figure 4:
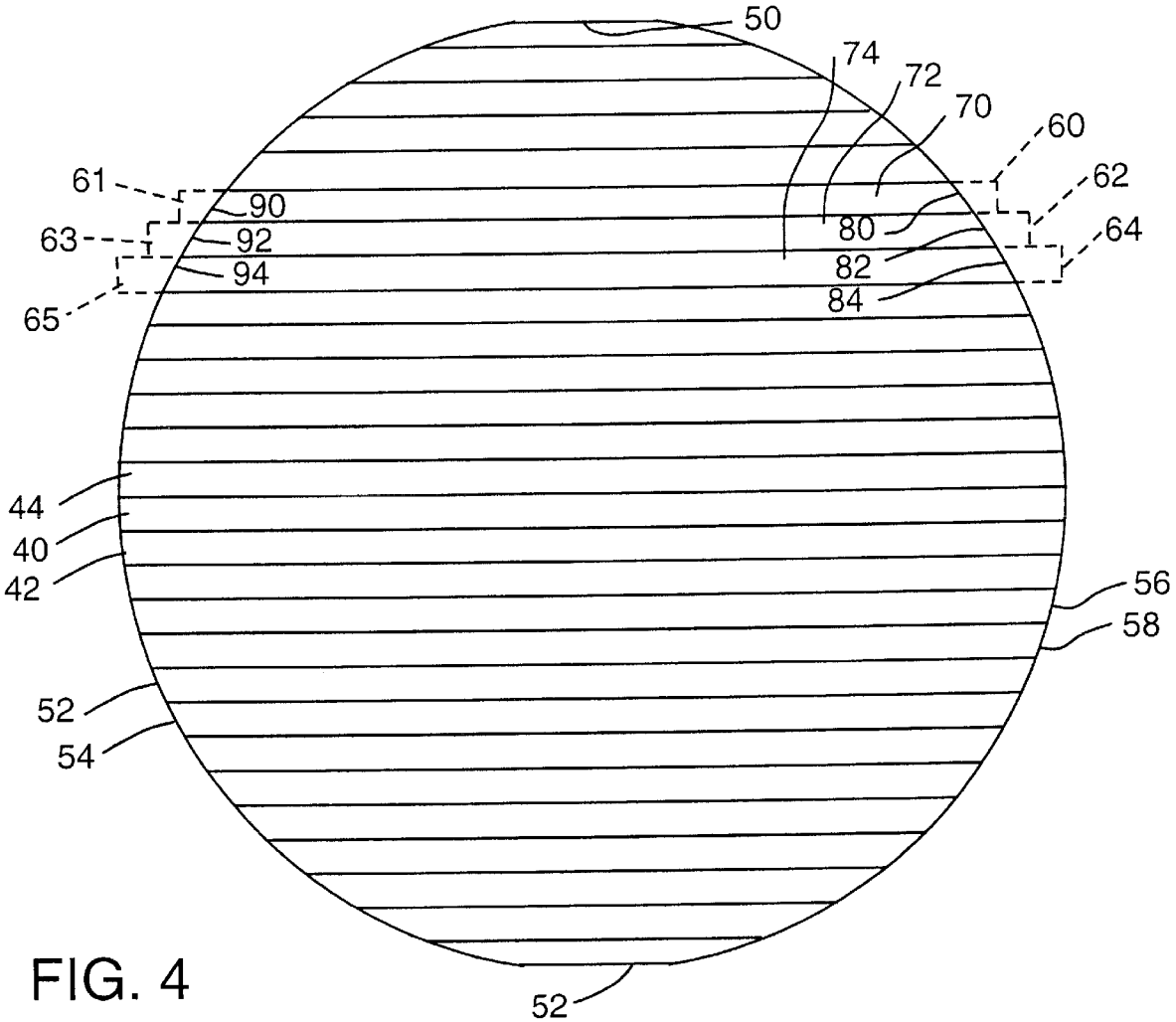
FIG. 4 is a cross-sectional illustration of an ignition core of the present invention.

Referring to FIGS. 3 and 4, the individual lamina, such as 40, 42, 44, are generally rectangular in plan and have a substantially uniform thickness. A core will have a plurality of individual elements, such as 40, 42, 44, of different widths as shown in the final core illustrated in FIG. 3. If desired, an upper extremity may have a flat portion 50 and an opposed lower portion may have a flat portion 52. The preferred embodiment of the present invention provides a circular cross-sectional configuration for the core or a substantially circular configuration.

The core, as a result of being substantially circular, will have greater weight for a given core diameter, as a result of the generally solid cross-section as compared with a conventional stepped configuration of the same diameter.

Referring to FIGS. 3 and 4, it will be seen that the lateral sidewalls or edges of the lamina elements, such edges 52, 54, 56, 58, are not oriented generally perpendicular to the transverse axis of the element of which they form a part, but rather tend to be curved or angularly shaped with respect thereto. This contributes to the substantially circular configuration of the overall core. It will be noted that the maximum width elements appear toward the center of the core with the elements being of progressively reduced width on opposed sides of the center as their position becomes closer to the flat portions 50, 52. The flat surfaces 50, 52 if provided, will have a width substantially less than the diameter of the core. In general, the overall diameter of the core will be an average of about 0.375 to 0.5 inch.

Referring once again to FIG. 4, a preferred method of making the core of the present invention will be considered. The original assembly of laminated elements has the elements oversized in width and provided in a stepped oversized relationship with respect to the desired ultimate configuration. Examples of such oversized lamina are shown in the dotted lines designated 60, 62, 64 and 61, 63, 65. It is generally desirable to have the width of these individual lamina, such as 60, 62, 64, for example, enlarged throughout the entire assembly with respect to the final lamina size, such as lamina 70, 72, 74. In establishing the desired substantially circular core configuration, the assembly is clamped by suitable means and subjected to mechanical machining such that the dotted portions of elements 60, 69, 64 will be removed. In the specific element selected for illustrative purposes, the configuration of dotted portion 60 will become that of solid line 80, the configuration of dotted portion 62 will become that of solid line 82, and the dotted portion 64 will have the final configuration 84 which, as is apparent, will cooperate to define an arc of the circle. Similar machining will result in the dotted portions 61, 63, 65 assuming the final solid configurations 90, 92, 94, respectively. After the desired configuration is achieved, the assembly is established by joining as by welding at the ends, such as end 100 shown in FIG. 3, and the opposed end. Such welding can be effected by tig or laser welders, for example. This results in effective retention of the laminated assembly with the individual laminated elements in intimate surface-to-surface contact, while not providing any undesirable stepped structure on the exterior surface of the core which would interfere with the winding of the primary winding thereof.

Mechanical machining may tend to produce burrs on the lateral portions of the elements and such burrs may provide undesired electrically conductive paths between laminations which produce electrical shorts. Mechanical machining may also produce undesired smears. The burrs may be removed by any desired means, such as etching, for example. A preferred approach to burr and smear elimination is to employ electrochemical machinery as well known to those skilled in the art. Such an approach is rapid and does require tool contact with the burrs being removed.

In general, a majority of the laminated lamina elements will be of substantially uniform thickness throughout and of generally equal thickness with respect to the other lamina. For some purposes where it is desired to achieve a specific overall thickness for the core which cannot be achieved with such uniformity, one or more laminas having a different thickness from the other may be interposed in the core structure.

It will be appreciated that the system is adapted for rapid continuous production or for certain specialty items may be employed to produce individual units with machine operators handling the individual components at various stages of manufacture.

It will be appreciated, therefore, that the present invention provides a unique ignition coil and substantially circular core and the method of making the same. The core is substantially circular in peripheral configuration and thereby eliminates undesired aspects of the prior art stepped laminated configuration. It provides a solid cross-section with more metal than if a circle of the same diameter had a stepped configuration. The result is a core having greater weight per given diameter and a smooth exterior configuration. The method of making the same involves providing specifically dimensioned oversized laminates which are reduced in width and contoured so as to cooperate with the other lamina elements in creating the overall substantially circular configuration. The method may be practiced on an individual basis, semi-automated, or an automated basis.

While reference has been made herein to creating a clamped assembly and mechanically machining and Electrochemically machining the same prior to joining in order to create the core, if desired, the individual elements may be shaped and subsequently assembled with the assembly being joined as by welding.

Whereas particular embodiments of the invention have been described herein for purposes of illustration, it will be evident for those skilled in the art that numerous variations of the details may be made without departing from the invention as set forth in the appended claims.

What is claimed is:

1. An ignition coil comprising an elongated substantially circular coil core, a primary coil disposed radially outwardly of said core, a secondary coil disposed radially outwardly of said core, said core composed of a plurality of generally rectangular elements at least some of which have different widths than others, and said elements being in surface to surface contact with each other.

2. The ignition coil of claim 1 including said core having a greater weight than a stepped core of the same diameter.

3. The ignition coil of claim 2 including said core having a circumferential surface which is substantially smooth.

4. The ignition coil of claim 1 including said core being substantially burr-free.

5. The ignition coil of claim 1 including said core having a length to maximum width ratio of about 4.5 to 8.

6. The ignition coil of claim 1 including said elements being welded to adjacent said elements.

7. The ignition coil of claim 6 including said core having a pair of end walls oriented generally perpendicular to the longitudinal axis of said core, and said elements being welded at said end walls.

8. The ignition coil of claim 1 including said elements disposed at or adjacent the center of said core having a greater width than said elements positioned farther from said center.

9. The ignition coil of claim 8 including said ignition coil being an automotive ignition coil.

10. The ignition coil of claim 1 including said core having a diameter of about 0.375 to 0.5 inch.

11. An ignition coil, comprising:

an elongated, substantially circular coil core;

a primary coil disposed radially outwardly of said core;

a secondary coil disposed radially outwardly of said core;

said core composed of a plurality of generally rectangular elements, at least some of which have different widths than others;

said elements being in surface to surface contact with each other; and at least a majority of said elements having lateral sidewalls that are not perpendicular to longitudinal extents of said elements.

12. The ignition coil of claim 11 including at least a majority of said element sidewalls being curved.

13. A core for an ignition coil comprising said core having an elongated substantially circular coil configuration, said core composed of a plurality of generally rectangular elements, at least some of which have a different width than others, and said elements being in surface-to-surface contact with each other.

14. The core of claim 13 including said core having a greater weight than a stepped core of the same diameter.

15. The core of claim 14 including said core having a circumferential surface which is substantially smooth.

16. The core of claim 13 including said elements being substantially burr-free.

17. The core of claim 13 including said core having a length to maximum width ratio of about 4.5 to 8.

18. The core of claim 13 including said elements being welded to adjacent said elements.

19. The core of claim 18 including said core having a pair of end walls oriented generally perpendicular to the longitudinal axis of said core, and said elements being welding at said end walls.

20. The core of claim 13 including said elements disposed at or adjacent the center of said core having a greater width than said elements positioned farther from said center.

21. The core of claim 20 including said ignition coil being an automotive ignition coil.

22. The core of claim 13 including said core having a diameter of about 0.375 to 0.5 inch.

23. A core for an ignition coil, comprising:

said core having an elongated, substantially circular coil configuration;

said core composed of a plurality of generally rectangular elements, at least some of which have a different width than the others;

said elements being in surface-to-surface contact with each other; and at least a majority of said elements having lateral sidewalls that are not perpendicular to the longitudinal extent of said elements.

24. The core of claim 23 including at least a majority of said element sidewalls being curved.

25. A method of making an ignition coil core comprising providing a plurality of generally rectangular elongated generally flat metal elements at least some of which have a different width than others, assembling said elements with the elements of greatest width in the center and elements of progressively reduced width secured on a opposed sides thereof, machining the lateral edges of at least a majority of said elements to create a core having a substantially circular core shape, and joining said assembly of elements to create said core.

26. The method of claim 25 including effecting said joining by welding the ends of said assembly.

27. The method of claim 26 including effecting said welding after said machining.

28. The method of claim 25 including prior to said machining establishing said assembly with a generally stepped exterior configuration.

29. The method of claim 25 including creating said core with a length to maximum width ratio of about 4.5 to 8.

30. The method of claim 25 including employing said method to create an automotive ignition core.

31. The method of claim 25 including subsequent to said machining, deburring said assembly.

32. The method of claim 31 including effecting said deburring by electrochemical machining.

33. The method of claim 31 including effecting said welding after said deburring.

34. The method of claim 25 including creating said core with a diameter of about 0.375 to 0.5 inch.

35. A method of making an ignition coil core, comprising:

providing a plurality of generally rectangular, elongated, generally flat metal elements, at least some of which have a different width than others;

assembling said elements with the elements of greatest width in the center and elements of progressively reduced widths secured on opposed sides thereof;

establishing said assembly with a generally stepped exterior configuration; machining the lateral edges of at least a majority of said elements to create a core having a substantially circular shape; and creating said core with a pair of opposed flat surfaces.

36. The method of claim 25 including creating said core with a greater weight per diameter than a corresponding core of stepped configuration and the same diameter.

37. The method of claim 36 including creating said core with a smooth circumference.

* * * * *

UNITED STATES PATENT AND TRADEMARK OFFICE

CERTIFICATE OF CORRECTION

PATENT NO. : 6,501,365 B1 
DATED : December 31, 2002
INVENTOR(S) : E. Wesley Elliott et al.

It is certified that error appears in the above-identified patent and that said Letters Patent is hereby corrected as shown below:

Column 2,
Line 47, "farther" should read -- further --.

Signed and Sealed this

Thirteenth Day of May, 2003

JAMES E. ROGAN
*Director of the United States Patent and Trademark Office*